US006886794B2

(12) United States Patent
Pollack

(10) Patent No.: US 6,886,794 B2
(45) Date of Patent: May 3, 2005

(54) TISSUE BOX HOLDER

(76) Inventor: Ronald M. Pollack, 69-37 Harrow St., Forest Hills, NY (US) 11375

( * ) Notice: Subject to any disclaimer, the term of this patent is extended or adjusted under 35 U.S.C. 154(b) by 0 days.

(21) Appl. No.: 10/456,691

(22) Filed: Jun. 6, 2003

(65) Prior Publication Data

US 2004/0245422 A1 Dec. 9, 2004

(51) Int. Cl.[7] ..... A47F 5/00

(52) U.S. Cl. ..... 248/310; 248/205.1; 248/316.7; 248/905

(58) Field of Search ..... 248/310, 311.2, 248/313, 309.1, 150, 205.1, 316.7, 316.1, 905, 309.4; 224/282

(56) References Cited

U.S. PATENT DOCUMENTS 3,801,056 A * 4/1974 Brody ..... 248/205.1
4,809,897 A * 3/1989 Wright, Jr. ..... 224/282
4,913,312 A * 4/1990 Boutin ..... 221/45
4,967,988 A * 11/1990 Nguyen ..... 248/150
5,197,705 A * 3/1993 Baskas ..... 248/316.7
5,314,103 A * 5/1994 Li ..... 224/282
5,863,089 A * 1/1999 Ignarra et al. ..... 296/37.8
5,979,849 A * 11/1999 Williams ..... 248/309.1
6,543,737 B2 * 4/2003 Decker et al. ..... 248/316.1

* cited by examiner

*Primary Examiner*—Leslie A. Braun
*Assistant Examiner*—Tan Le
(74) *Attorney, Agent, or Firm*—Galgano & Burke, LLP

(57) ABSTRACT

A tissue box holder includes a frame composed of a generally planar base and a normally upstanding sidewall attached to, and surrounding, the base within which a tissue box can be seated. A gripping device is provided for gripping the tissue box mounted on the sidewall. At least one portion of the sidewall is hingedly coupled to the planar base for movement between a open position, in which the at least one portion is pivoted away from adjacent portions of the sidewall of the frame, and a closed position, in which the at least one portion is pivoted to an upright position abutting the adjacent portions of the upstanding sidewall of the frame.

19 Claims, 7 Drawing Sheets

TISSUE BOX HOLDER

BACKGROUND OF THE INVENTION

1. Field of the Invention

The invention relates to an apparatus for holding a tissue box. More particularly, the invention relates to a tissue box holder which can be mounted on a surface and which securely holds a tissue box without damaging or distorting the box.

2. Brief Description of the Prior Art

For many years tissues have been provided in cardboard boxes in which the tissues are folded and interleaved so that as one tissue is removed another is pulled partially put of the box. Since these tissue boxes were first introduced, many people have recognized that it would be desirable to provide a tissue box holder. There are many reasons to provide a tissue box holder. One reason is to locate the tissue box in a relatively permanent location so that tissues are conveniently placed when needed. Another reason is to enable the location of a tissue box on a vertical surface such as a wall, or on a horizontal surface such as the underside of a desk. Another reason to provide a tissue box holder is to hold the box stationary while a tissue is pulled from it.

The prior art contains many examples of tissue box holders. Some of the prior tissue box holders are surprisingly complex and others are simply incomplete. In general, the simple tissue box holders do not work very well and the holders which do work are too complex when it comes to replacing a tissue box.

SUMMARY OF THE INVENTION

It is therefore an object of the invention to provide an effective tissue box holder.

It is also an object of the invention to provide a tissue box holder which can be secured to a vertical surface.

It is another object of the invention to provide a tissue box holder which is easy to operate.

It is yet another object of the invention to provide a tissue box holder which securely holds a box of tissues without deforming or damaging the tissue box.

It is another object of the invention to provide a tissue box holder which is inexpensive and easy to manufacture.

It is still another object of the invention to provide a tissue box holder which may be secured to virtually any surface in a number of ways.

Certain of the foregoing and related objects are achieved according to the present invention by the provision of a tissue box holder comprising a frame composed of a generally planar base and a normally upstanding sidewall attached to, and surrounding, said base within which a tissue box can be seated, and means for gripping the tissue box mounted on said sidewall, wherein at least one portion of said sidewall is hingedly coupled to said planar base for movement between a open position, in which said at least one portion is pivoted away from adjacent portions of said sidewall of said frame, and a closed position, in which said at least one portion is pivoted to an upright position abutting said adjacent portions of said upstanding sidewall of said frame.

Preferably, the sidewall is composed of four sides, one side of which defines said at least one portion and two other of said sides which are adjacent to said one side define said adjacent portions. Advantageously, the four sides are composed of two opposite long sides and two opposite short sides.

In a preferred embodiment, the tissue box holder additionally includes means for releasably securing said one side in said closed position. Preferably, the means for releasably securing comprise resilient mechanical interlocking members engageable in a resilient snap-fit manner. These may, e.g., comprise Velcro® hook and loop mechanical fasteners. Alternatively, said one side has at least one hook which engages a boss on at least one of said two other sides, said hook and boss cooperatively defining said means for releasably securing. Most desirably, each of said long sides is provided with a boss at one end and said hingedly coupled side is provided with a pair of hooks adapted to engage said bosses, said hooks and bosses cooperatively defining said means for releasably securing. Alternatively or in combination therewith, said one side has at least one lug and said base has at least one receiving hole, said lug being frictionally receivable in said hole, said lug and hole cooperatively deferring said means for releasably securing.

In a particularly preferred embodiment of the invention, the means for gripping are located on said two short sides. Most advantageously, the means for gripping comprise gripping ribs have a saw tooth profile.

In an especially preferred embodiment, two mounting holes for removably mounting the tissue box holder on a surface and one hanging hole for hanging the tissue box holder on a point of sale display hooks are provided in said base. Most desirably, said sidewall and said base are formed as a single injection molded plastic member and said at least one portion is hingedly, coupled to said planar base via a living hinge.

Certain of the foregoing and related objects are also attained according to the invention by a tissue box holder, comprising a frame having a generally planar base and a normally upstanding sidewall attached to said base adjacent to which a tissue box can be seated, means for gripping the tissue box mounted on said sidewall and at least one portion of said sidewall being hingedly coupled to said planar base for movement between an open position in which said at least one portion is pivoted downwardly relative to said base, and a closed position, in which said at least one portion is pivoted to an upright position relative to said base.

Additional objects and advantages of the invention will become apparent to those skilled in the art upon reference to the detailed description taken in conjunction with the provided figures.

DETAILED DESCRIPTION

Figure 1:
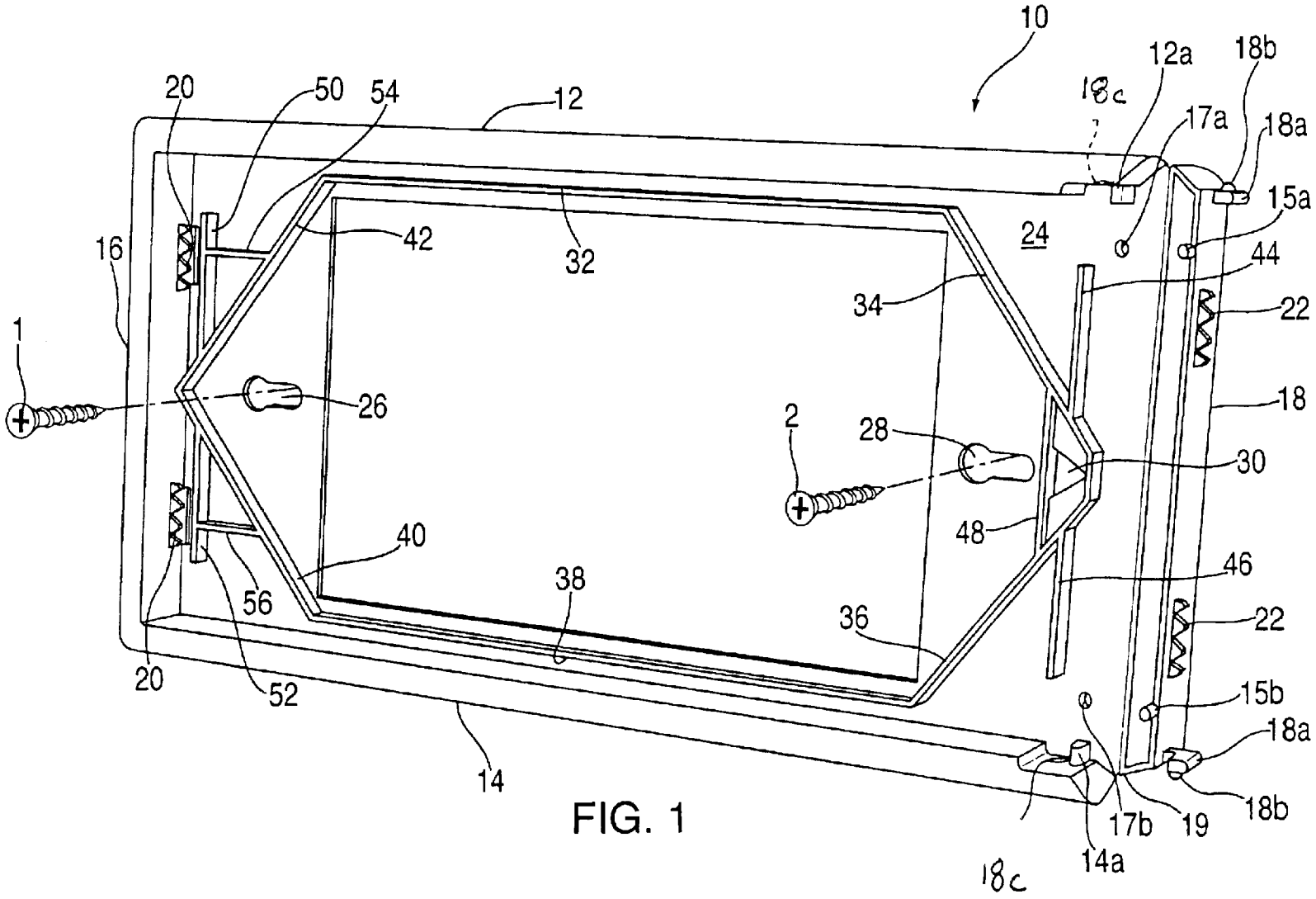
FIG. 1 is a perspective view of a tissue box holder according to the invention with the side door open and illustrating the placement of two mounting screws.
Figure 2:
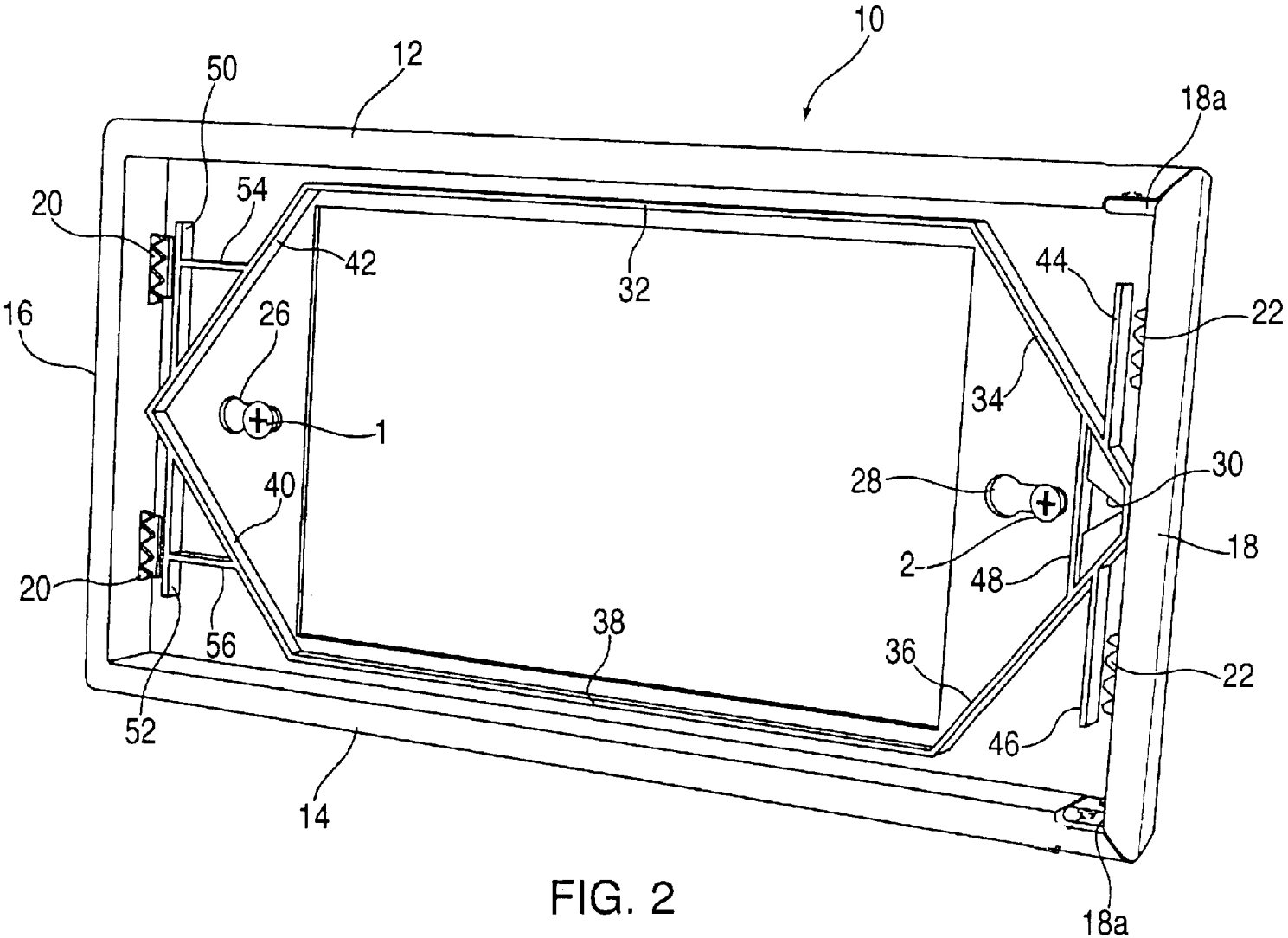
FIG. 2 is a view similar to FIG. 1 but with the side door closed and the mounting screws in position.
Figure 3:
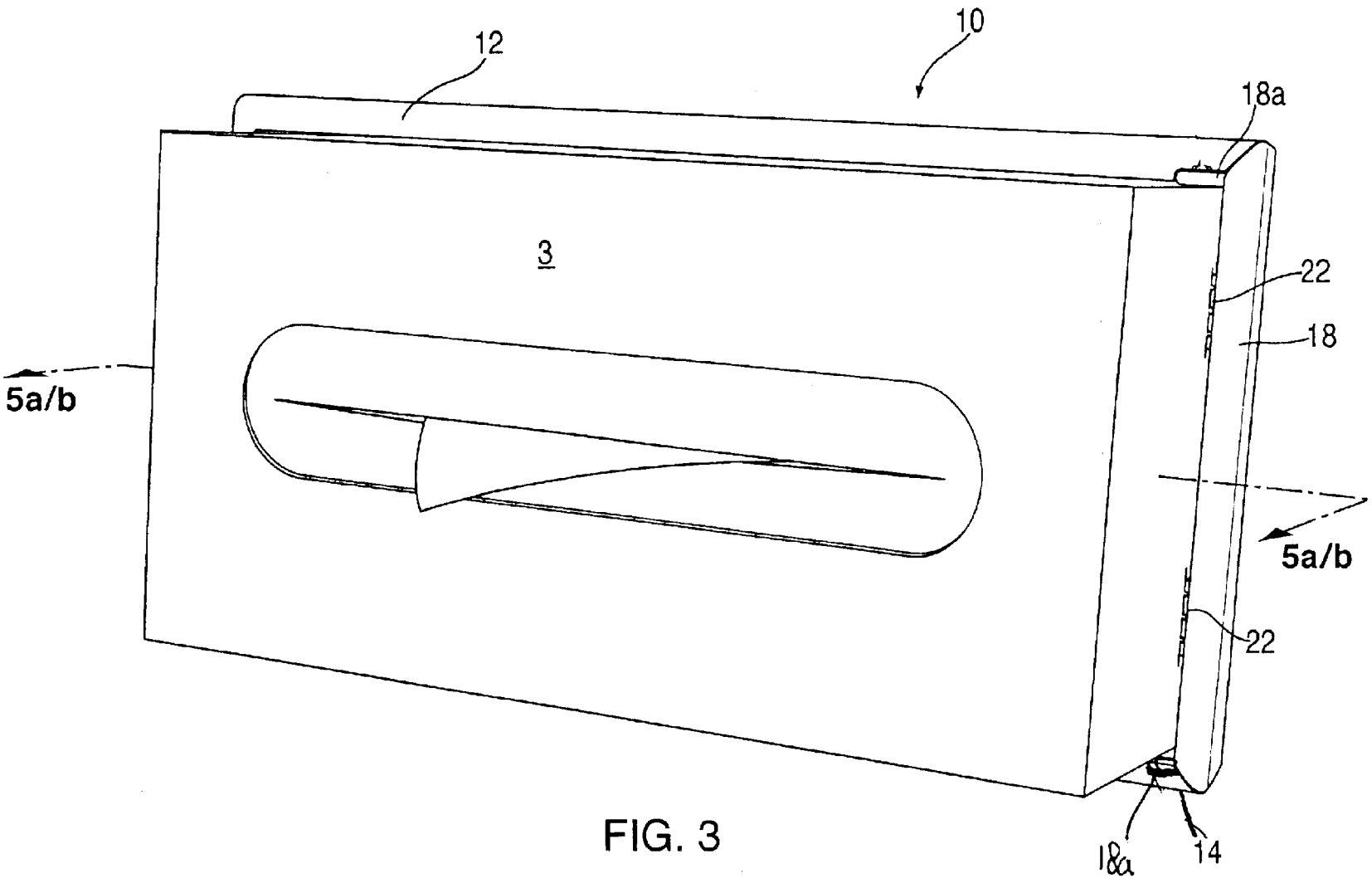
FIG. 3 is a view similar to FIG. 2 but with a tissue box installed.
Figure 4:
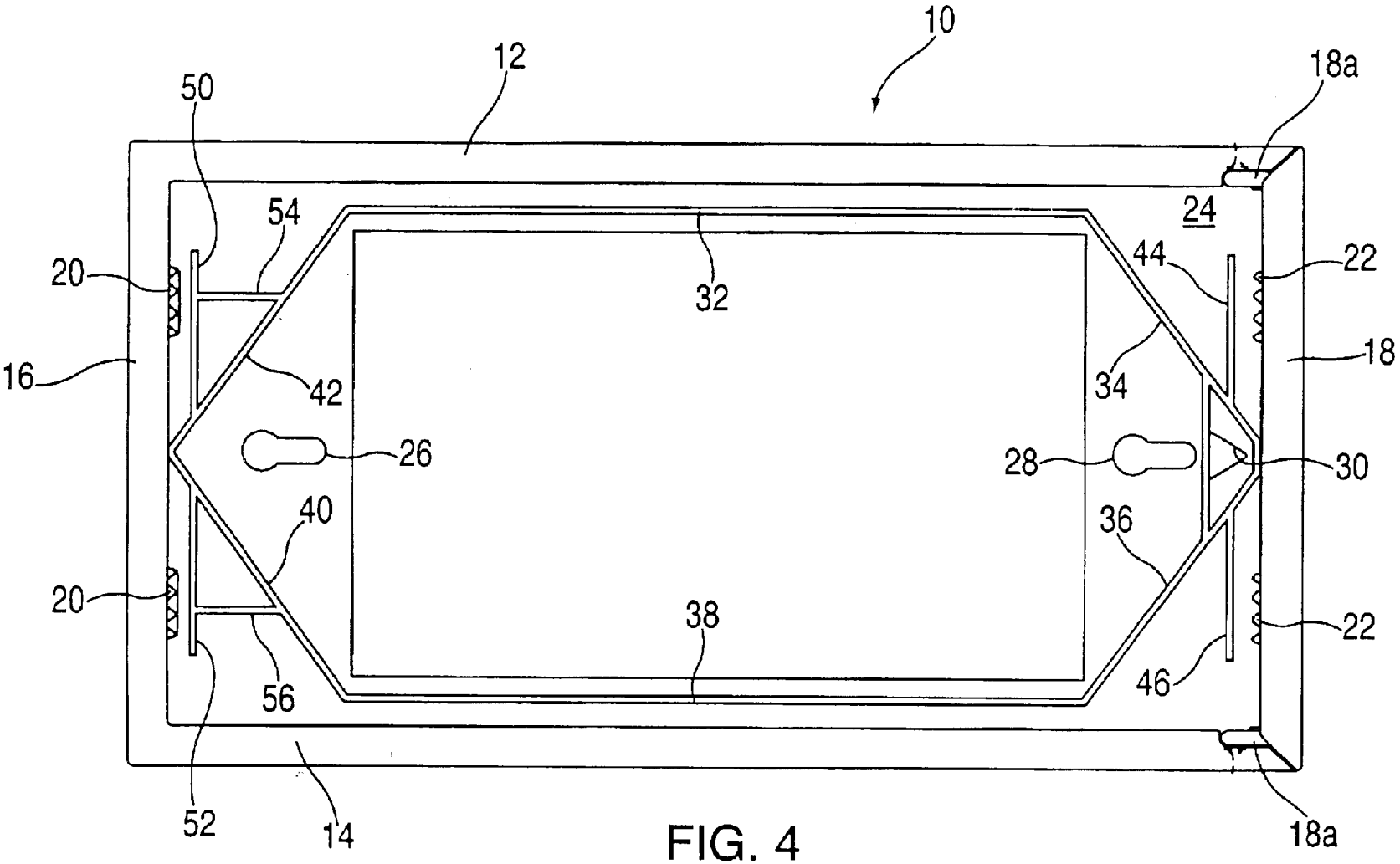
FIG. 4 is a top plan view of the tissue box holder with the side door closed.

Turning now to the Figures, a tissue box holder 10 according to the invention includes a rectangular frame having two long sides 12, 14 and two short sides 16, 18. The two short sides are each provided with a plurality preferably of saw-tooth-shaped gripping ribs 20, 22 which serve to grab the sides near the bottom of a box of tissues 3. The frame includes an interior floor or base portion 24 which defines two mounting hole 26, 28, and a hanging hole 30 and which includes a plurality of supporting ribs 32, 34, 36, 38, 40, 42, 44, 46, 48, 50, 52, 54, 56. One of the short sides 18 is hingedly coupled to the floor 24.

Figure 5A:
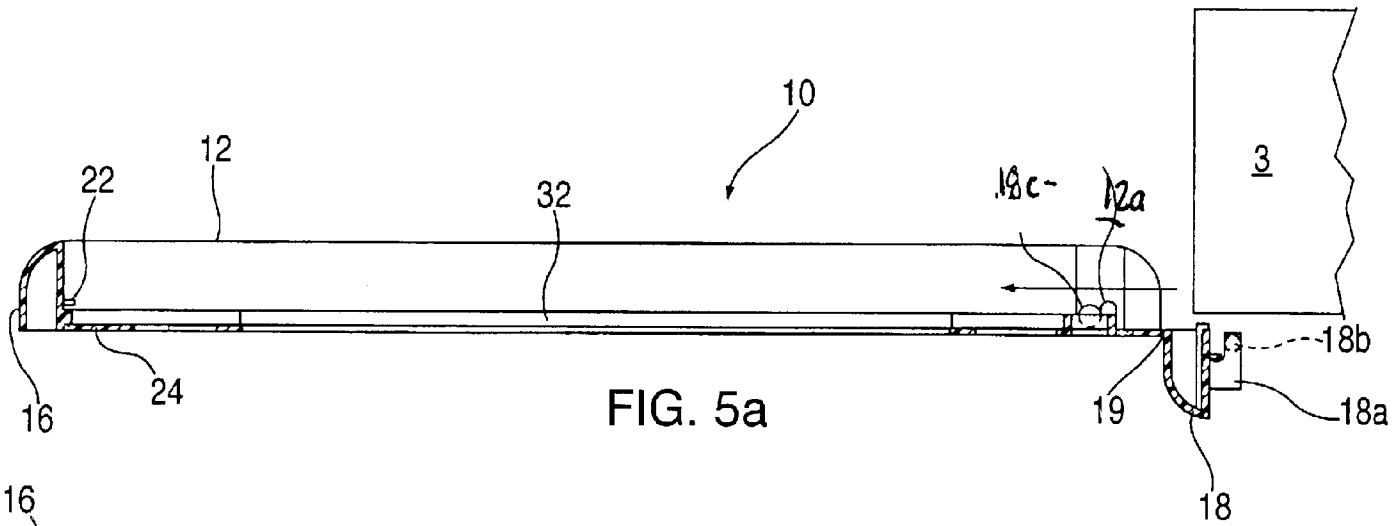
FIG. 5*a* is a section taken along line 5*a*/*b*—5*a*/*b* in FIG. 3 with the side door open and the tissue box removed.
Figure 5B:
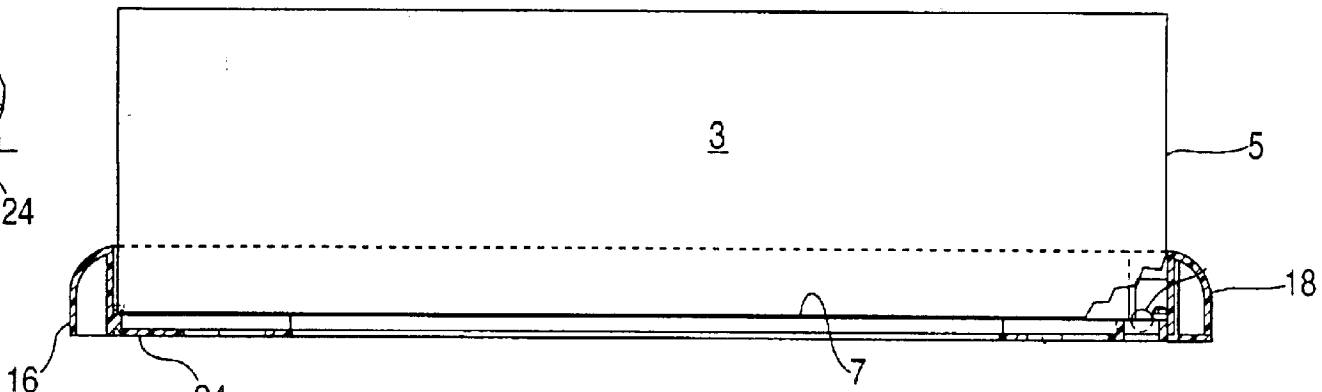
FIG. 5*b* is a view similar to FIG. 5*a* but with the side door closed and the tissue box installed.
Figure 7:
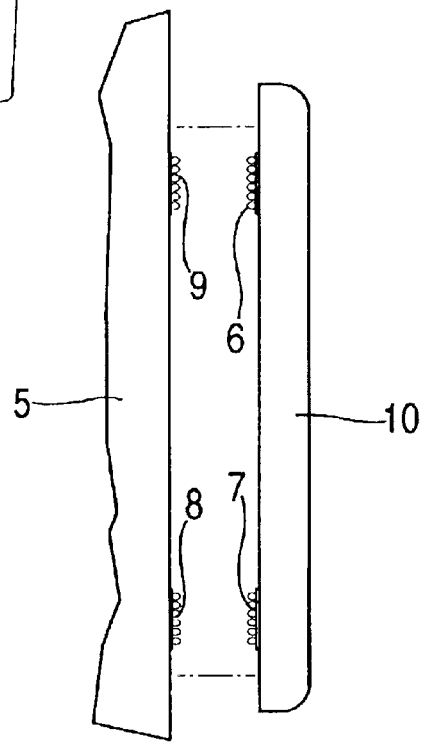
FIG. 7 is a side elevation view illustrating alternative mounting means.

Holder 10 may be secured to a surface with screws 1, 2 through the keyhole openings 26, 28. However, other mounting means may be employed, such as shown in FIG. 7, where it is secured to a surface 5 with VELCRO®-type hook and loop mechanical interlocking fasteners 6, 7, 8, 9. In any case, it will be appreciated that holder 10 may be easily removed from the surface so as to allow side door 18 to be opened as seen best in FIGS. 1 and 5*a*. With the side door opened, a tissue box 3 may be slid into the apparatus as indicated by the arrow in FIG. 5*a*.

Figure 5C:
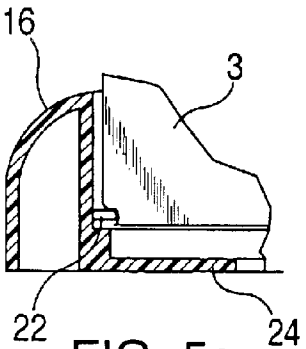
FIG. 5*c* is an enlarged sectional view of the tissue holder and tissue box shown in FIG. 5*b*.

As mentioned above, the gripping ribs 20, 22 are preferably located such that they securely grip the sidewall 5 of the tissue box just above the base wall 7 of the tissue box 3. As seen best in FIG. 5*c*, this causes an inward deformation of the tissue box sidewall 5 closely adjacent the base wall 7. However, the remainder of the sidewall, particularly the portion visible above the side 18, maintains its planar, non-deformed state. The supporting ribs 32–56 are arranged to elevate the bottom of the tissue box above the heads of the screws 1, 2. They also provide a surface on which tissue box 3 can slide into place and they add strength to the apparatus.

Figure 8A:
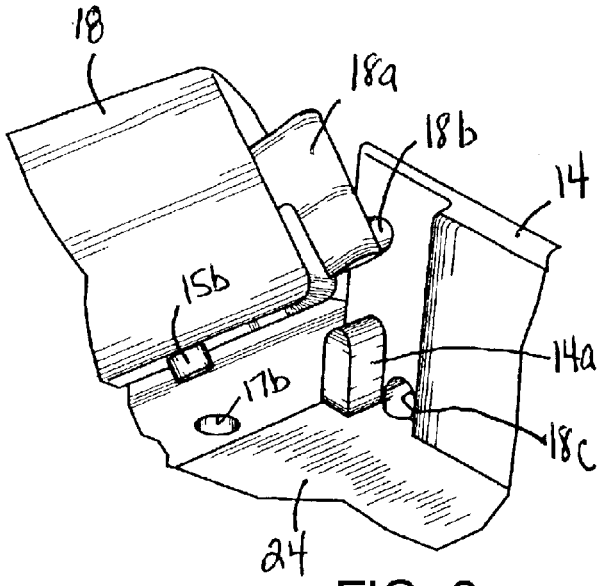
FIGS. 8*a*–8*c* are enlarged, partial elevational views sequentially illustrating the closing and locking of the side door.
Figure 8B:
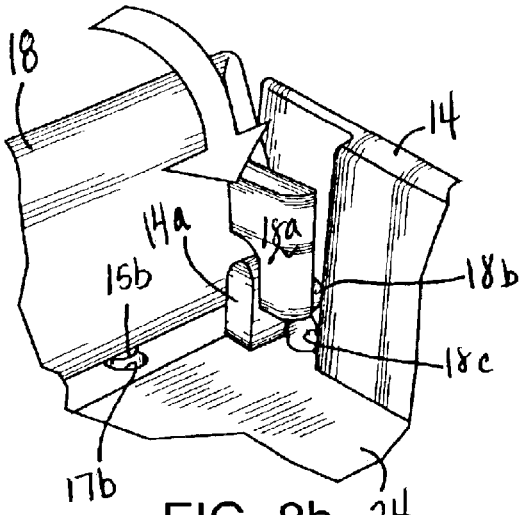
Figure 8C:
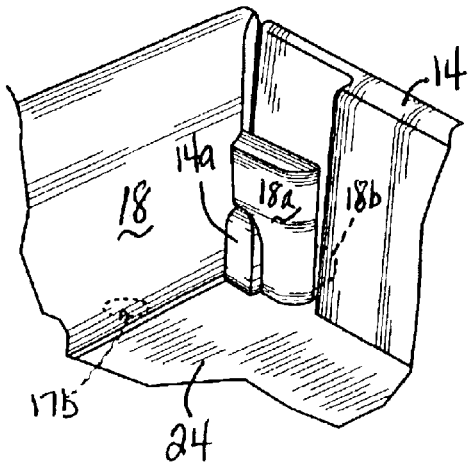

According to the presently preferred embodiment, and as best seen in FIGS. 8*a*–8*c*, the side door 18 is provided with generally L-shaped hooks 18*a*, which engage bosses 12*a*, 14*a* when the door is closed. Preferably, they engage in a snap-fit resilient manner. Hooks 18*a* are preferably each provided with a cylindrical plug or lug 18*b* on the outer surface of their respective free leg which is positioned to frictionally engage and be releasably receivable in a corresponding receiving hole 18*c* formed in sidewall 14. In addition, the side door 18 is also preferably provided with a pair of cylindrical plugs or lugs 15*a*, 15*b* which are positioned to frictionally engage a corresponding pair of receiving holes 17*a*, 17*b* formed in the base 24, as an additional measure of mechanical interlock. Preferably, the entire apparatus is formed as a single piece of injection molded plastic with the side door 18 coupled to the base 24 by a living hinge 19.

Figure 6:
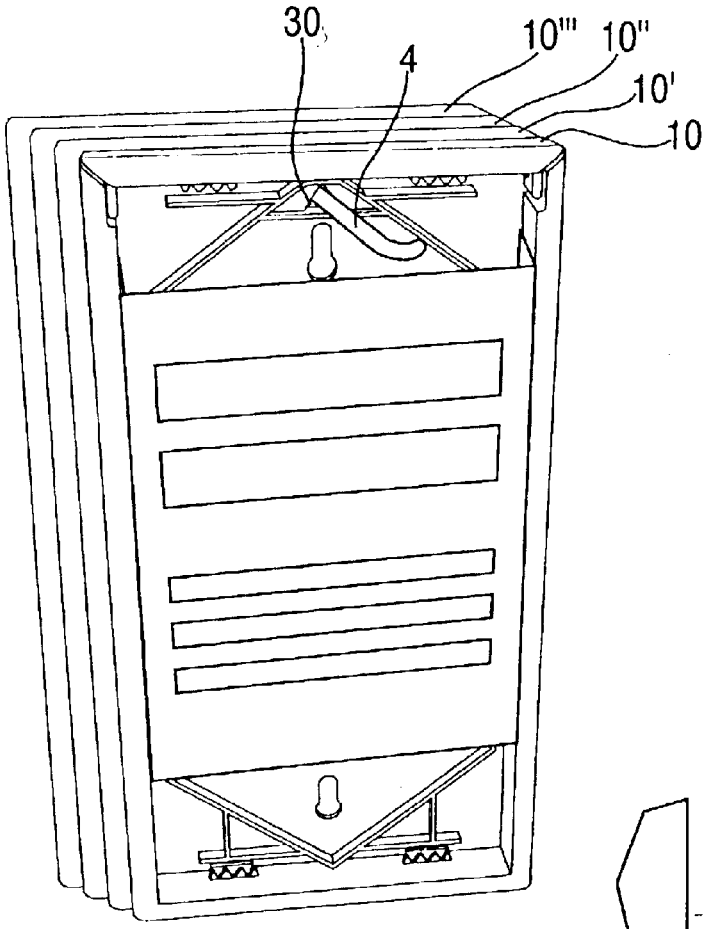
FIG. 6 is a perspective view of a plurality of tissue box holders at a point of sale display.

As illustrated in FIG. 6, a plurality of tissue box holders 10, 10', 10", 10'" may be individually shrink wrapped with marketing indicia and suspended on a point of sale display hook 4 via the hole 30. Hole 30 is located close to one of the short sides of holder 10 so that the center of gravity of the apparatus 10 is far enough from the hole 30 so that the tissue box holders hang straight.

There have been described and illustrated herein preferred embodiments of a tissue box holder. While particular embodiments of the invention have been described, it is not intended that the invention be limited thereto, as it is intended that the invention be as broad in scope as the art will allow and that the specification be read likewise. For example, although the holder is specifically designed to hold rectangular tissue boxes, it can be readily adapted and configured to hold differently shaped boxes (e.g., round, oval, square, polygonal, etc.). In addition, although the means for gripping preferably comprise saw-tooth shaped gripping ribs, other gripping means may be employed. Similarly, other means for releasably locking the hingedly-coupled wall may be employed. It will therefore be appreciated by those skilled in the art that yet other modifications could be made to the provided invention without deviating from its spirit and scope as so claimed.

What is claimed is:

1. A tissue box holder, comprising:

a frame having a generally planar base and a normally upstanding sidewall attached to said base adjacent to which a tissue box can be seated;

at least one first portion of said sidewall being hingedly coupled to said planar base for movement between a open position, in which said at least one first portion is pivoted downwardly relative to said base, and a closed position, in which said at least one first portion is pivoted to an upright position relative to said base, wherein said sidewall surrounds said base and is configured and dimensioned to permit a tissue box to be seated therewithin, and wherein said at least one first portion of said sidewall, in said open position thereof, is pivoted away from adjacent portions of said sidewall of said frame and wherein in said closed position thereof, it generally abuts said adjacent portions of said upstanding sidewall of said frame, said sidewall having an inwardly directed face and a second portion disposed opposite said first portion;

means for gripping the tissue box mounted on said inwardly directed face of said first and second portions of said sidewall, said gripping means being inwardly directed so as to grab the opposite sides of a tissue box disposed therebetween; and means for releasably securing said one side in said closed position.

2. A tissue box holder according to claim 1, wherein said sidewall is composed of four sides, one side of which defines said at least one first portion, the side opposite said one side defines said second portion and the two remaining sides which are adjacent to said one side define said adjacent portions.

3. A tissue box holder according to claim 2, wherein said four sides is composed of two opposite long sides and two opposite short sides.

4. A tissue box holder according to claim 1, wherein said means for releasably securing comprise resilient mechanical interlocking members engageable in a resilient snap-fit manner.

5. A tissue box holder according to claim 1, wherein said means for releasably securing comprise hook and loop mechanical fasteners.

6. A tissue box holder according to claim 5, wherein:

said base is provided with a plurality of upstanding supporting ribs on which the tissue box may be supported.

7. A tissue box holder according to claim 1, wherein:

each of said long sides is provided with a bass at one end and said hingedly coupled side is provided with a pair of hooks adapted to engage said bosses, said hooks and bosses cooperatively defining said means for releasably securing.

8. A tissue box holder according to claim 1, wherein:

said one side has at least one hook which engages a boss on at least one of said two other sides, said hook and boss cooperatively defining said means for releasably securing.

9. A tissue box holder according to claim 8, wherein said at least one hook has a lug formed thereon and wherein at least one of said two other sides has a receiving hole in which said lug is frictionally receivable.

10. A tissue box holder according to claim 1, wherein said one side has at least one lug and said base has at least one receiving hole, said lug being frictionally receivable in said hole, said lug and hole cooperatively defining said means for releasably securing.

11. A tissue box holder according to claim 1, wherein said means for gripping comprise gripping ribs have a saw tooth profile.

12. A tissue box holder according to claim 2, further comprising:

two mounting holes for removably mounting the tissue box holder on a surface and one hanging hole for hanging the tissue box holder on a point of sale display hook provided in said base.

13. A tissue box holder according to claim 1, wherein said sidewall and said base are formed as a single injection molded plastic member and said at least one portion is hingedly coupled to said planar base via a living hinge.

14. A tissue box holder according to claim 1, wherein said means for gripping comprises gripping ribs which servo to grasp the sides of the tissue box near the bottom of the box.

15. A tissue box holder, comprising:

a frame having a generally planar base and a normally upstanding sidewall attached to said base adjacent to which a tissue box can be seated;

means for gripping the tissue box mounted on said sidewall;

at least one portion of said sidewall being hingedly coupled to said planar base for movement between a open position, in which said at least one portion is pivoted downwardly relative to said base, and a closed position, in which said at least one portion is pivoted to an upright position relative to said base, wherein said sidewall surrounds said base and is configured and dimensioned to permit a tissue box to be seated there within, and wherein said at least one portion of said sidewall, in said open position thereof, is pivoted away from adjacent portions of said sidewall of said frame and wherein in said closed position thereof, it generally abuts said adjacent portions of said upstanding sidewall of said frame, wherein said sidewall is composed of four sides, one side of which defines said at least one portion and two other of said sides which are adjacent to said one side define said adjacent portions; and means for releasably securing said one side in said closed position, wherein said one side has at least one hook which engages a boss on at least one of said two other sides, said hook and boss cooperatively defining said means for releasably securing; wherein said at least one hook has a lug formed thereon and wherein at least one of said two other sides has a receiving hole in which said lug is frictionally receivable.

16. A tissue box holder, comprising:

a frame having a generally planar base and a normally upstanding sidewall attached to said base adjacent to which a tissue box can be seated;

means for gripping the tissue box mounted on said sidewall;

at least one portion of said sidewall being hingedly coupled to said planar base for movement between a open position, in which said at least one portion is pivoted downwardly relative to said base, and a closed position, in which said at least one portion is pivoted to an upright position relative to said base, wherein said sidewall surrounds said base and is configured and dimensioned to permit a tissue box to be seated there within, and wherein said at least one portion of said sidewall, In said open position thereof, is pivoted away from adjacent portions of said sidewall of sold frame and wherein in said closed position thereof, it generally abuts said adjacent portions of said upstanding sidewall of said frame, wherein said sidewall is composed of four sides, one side of which defines said at least one portion and two other of said sides which are adjoint to said one side define said adjacent portions; and means for releasably securing said one side in said closed position, wherein said one side has at least one lug and said base has at least one receiving hole, said lug being frictionally receivable in said hole, said lug and hole cooperatively defining said means for releasably securing.

17. A tissue box holder, comprising:

a frame having a generally planar base and a normally upstanding sidewall attached to said base adjacent to which a tissue box can be seated;

means for gripping the tissue box mounted on said sidewall;

at least one portion of said sidewall being hingedly coupled to said planar base for movement between a open position, in which said at least one portion is pivoted downwardly relative to said base, and a closed position, in which said at least one portion is pivoted to an upright position relative to said base, wherein said sidewall surrounds said base and is configured and dimensioned to permit a tissue box to be seated there within, and wherein said at least one portion of said sidewall, in said open position thereof, is pivoted away from adjacent portions of said sidewall of said frame and wherein in said closed position thereof, it generally abuts said adjacent portions of said upstanding sidewall of said frame, wherein said sidewall is composed of four sides, one side of which defines said at least one portion and two other of said sides which are adjacent to said one side define said adjacent portions; and means for releasably securing said one side in said closed position;

said means for gripping the tissue box mounted on said sidewall comprising said gripping ribs having a saw tooth profile.

18. A tissue box holder, comprising: a frame having a generally planar base and a normally upstanding sidewall attached to said base adjacent to which a tissue box can be seated;

means for gripping the tissue box mounted on said sidewall;

at least one portion of said sidewall being hingedly coupled to said planar base for movement between a open position, in which said at least one portion is pivoted downwardly relative to slid base, and a closed position, in which said at least one portion is pivoted to an upright position relative to said base, wherein said sidewall surrounds said base and is configured and dimensioned to permit a tissue box to be seated there within, and wherein said at least one portion of said sidewall, in said open position thereof, is pivoted away from adjacent portions of said sidewall of said frame and wherein in said closed position thereof, it generally abuts said adjacent portions of said upstanding sidewall of said frame, wherein said sidewall is composed of four sides, one side of which defines said at least one portion and two other of said sides which are adjacent to said one side define said adjacent portions; and two mounting holes for removably mounting the tissue box holder on a surface and one hanging hole for hanging the tissue box holder on a point of sale display hook provided in said base.

19. A tissue box holder, comprising:

a frame having a generally planar base and a normally upstanding sidewall attached to said base adjacent to which a tissue box can be seated;

means for gripping the tissue box mounted on said sidewall;

at least one portion of said sidewall being hingedly coupled to said planar base for movement between a open position, in which said at least one portion is pivoted downwardly relative to said base, and a closed position, in which said at least one portion is pivoted to an upright position relative to said base, wherein said sidewall surrounds said base and is configured and dimensioned to permit a tissue box to be seated therewithin, and wherein said at least one portion of said sidewall, in said open position thereof, is pivoted away from adjacent portions of said sidewall of said frame and wherein in said closed position thereof, it generally abuts said adjacent portions of said upstanding sidewall of said frame, wherein said sidewall is composed of four sides, one side of which defines said at least one portion and two other of said sides which are adjacent to said one side define said adjacent portions, wherein said four sides is composed of two opposite long sides and two opposite short sides, wherein said means for gripping are located on said two short sides.

* * * * *